United States Patent [19]

Osting et al.

[11] Patent Number: 4,830,208

[45] Date of Patent: May 16, 1989

[54] TAMPER-EVIDENT CONTAINER-CLOSURE ASSEMBLY

[75] Inventors: Richard C. Osting, Phoenixville; William A. Conard, Harleysville, both of Pa.

[73] Assignee: The West Company, Phoenixville, Pa.

[21] Appl. No.: 145,274

[22] Filed: Jan. 19, 1988

[51] Int. Cl.[4] ..... B65D 41/34

[52] U.S. Cl. ..... 215/252; 215/274; 292/256.61

[58] Field of Search ..... 215/252, 274, 253; 220/319; 292/256.61, 256.6

[56] References Cited

U.S. PATENT DOCUMENTS

| | | | |
|---|---|---|---|
| 1,934,393 | 11/1933 | Westerbeck | 292/256.61 |
| 3,464,576 | 9/1969 | Rohde | 215/252 |
| 4,730,745 | 3/1988 | Perry | 215/274 X |

FOREIGN PATENT DOCUMENTS

| | | | |
|---|---|---|---|
| 553475 | 2/1958 | Canada | 215/252 |

*Primary Examiner*—Donald F. Norton

*Attorney, Agent, or Firm*—Eugene E. Renz, Jr.

[57] ABSTRACT

A tamper-proof ring for securing a closure over the open end of a container. The closure and container has a projection engageable by the ring which comprises an annular member which before application to a container-closure assembly has a generally cylindrical section of a diameter slightly greater than the greatest transverse dimension of the container. The closure projection and a radially inwardly directed flange at one end of the cylindrical section define a plurality of circumferentially spaced, generally axial score lines extending from the edge of the cylindrical section opposite the one end and terminates at the juncture of the flange and cylindrical section.

2 Claims, 1 Drawing Sheet

FIG.2
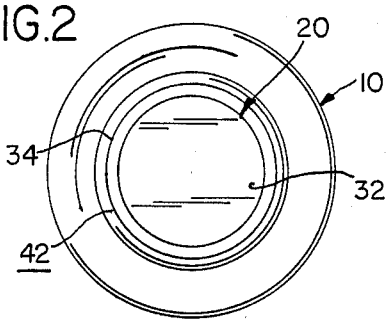
FIG.1
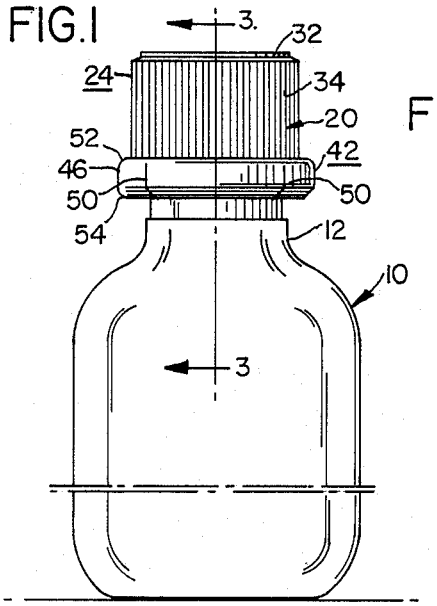
FIG. 4
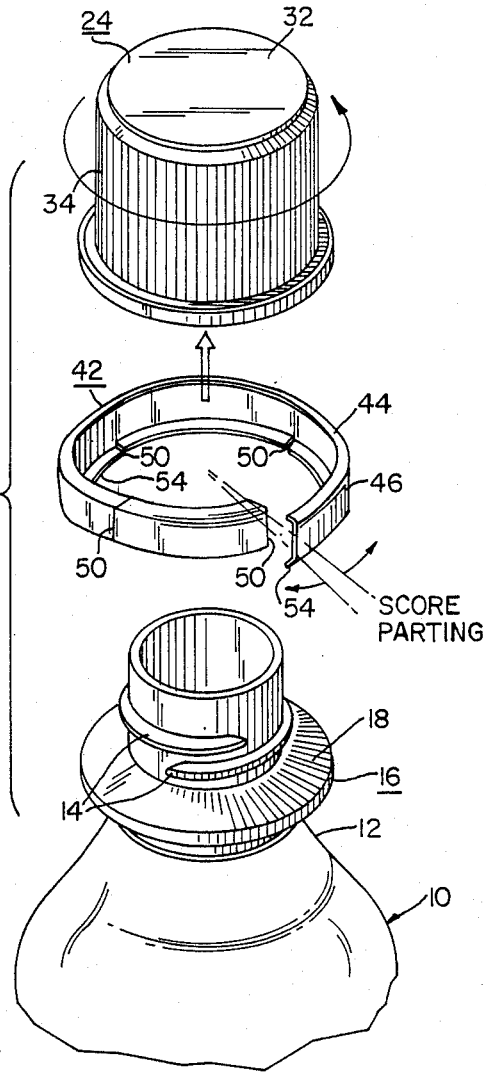
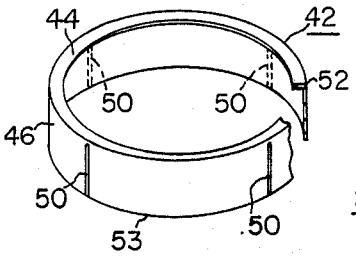
FIG.1a
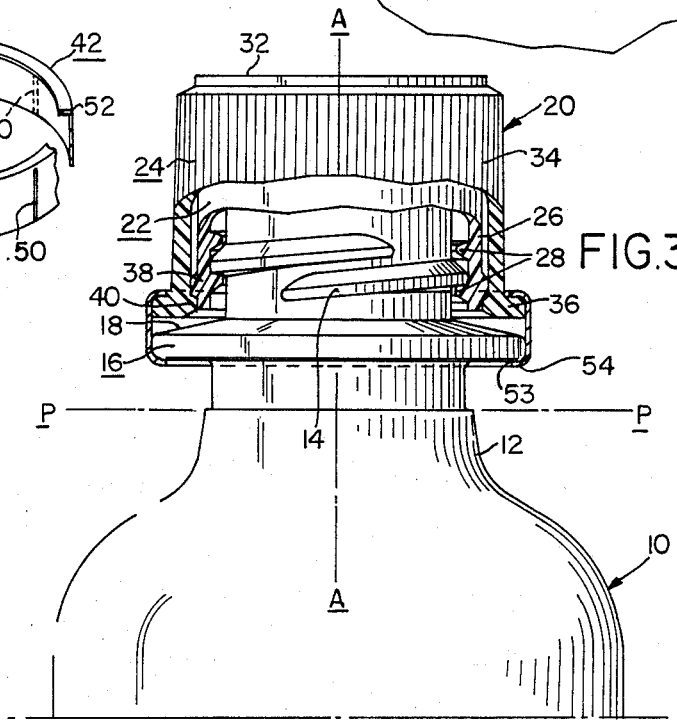
FIG.3

TAMPER-EVIDENT CONTAINER-CLOSURE ASSEMBLY

FIELD OF THE INVENTION

The present invention relates to improvements in so-called tamper-evident closures which is of relatively simplified construction and provides visual indicia or evidence of removal of the closure ensuring integrity of the product packaged in the container to the purchaser or user.

DESCRIPTION OF THE PRIOR ART

Tamper proofing containers for medicament products is important to insure integrity of the product and provide indicia where the closure has once been opened. Cases of tampering with medicament products are well known. Some instances of unnoticed tampering have resulted in death to the unsuspecting user of pharmaceutical products that were laced with a deadly poison. Thus, the need for truly tamper proof closure-containers particularly those assemblies used for medicaments is very important. Tamper-evident closures are not new per se. One form of prior known tamper-evident means which is quite common is the use of a so-called shrink wrap comprising, for example, a band of resilient material such as plastic which is tightly applied over the screw cap and the container such as a bottle at the juncture of the bottle finish and the lower terminal edge of the cap abuts the finish when it is fully seated. This arrangement has certain disadvantages and drawbacks. For example, it has been found that to provide an effective seal which is truly tamper-proof, the band must be applied so that it is tightly adhered to the peripheral surface of the cap and the bottle. Rather complicated and sophisticated, expensive equipment is needed for applying these shrink wraps to containers in the manner described above. It has been found that shrink wraps generally are extremely difficult to remove and that it is usually necessary, therefore, to utilize a sharp instrument such as a knife, or the like. This, of course, is an awkward, clumsy means for opening a container and sometimes results in injury to the user. Moreover, it is readily apparent that if the band is not applied very snugly, the cap can be removed and replaced without fracturing or breaking the band and thus, these shrink wraps are not truly tamperproof under all conditions.

Another form of tamper-proof closure means is shown in Rohde U.S. Pat. No. 3,464,576. There is illustrated in Rohde, a tamper-proof ring having a series of circumferentially spaced score lines extending the full width of the ring which is crimped in place over the lower edge of the cap and the bottle finish to form radially inwardly directed upper and lower flanges to seat the ring in place. Now when it is desired to gain access to the contents, the cap is simply rotated in a direction to remove it from the container which produces breaking of one or more of the bridges and release of the cap. The band is now fractured to a point where it will provide visual indicia that the cap has once been removed. While this system has been found to be generally satisfactory for the purposes intended, nevertheless, there are certain disadvantages and drawbacks. For example, it has been found that since the score lines extend the entire axial width of the ring, that some of the rings tend to be too fragile and fracture prematurely during the assembling operation. It has also been found that the turned in flanges are easier to wedge to a position where the ring can be removed and replaced without providing indicia to the user that the closure may have been once removed and replaced by reason of the fact that the scoring extends to the peripheral edge of each of the relatively short inturned flanges. Thus, the integrity of the product is jeopardized.

SUMMARY OF THE INVENTION

With the foregoing in mind, it is an object of the present invention to provide an improvement in tamper-proof closures which overcomes the disadvantages and drawbacks of prior arrangements discussed above. To this end, and in accordance with the present invention, a break-away band is provided which is continuous about its periphery and has a series of circumferentially spaced axial scores in the outer periphery thereof which extend only along the central portion and terminate at the juncture of the circumferential shoulders separating the annular portion from the radially inwardly directed flanges which engage over the cap and bottle finish to secure it in place. By this arrangement, the assembly is less fragile and less prone to being pried off and thus, is truly more tamper-proof than the prior assemblies discussed above.

BRIEF DESCRIPTION OF THE DRAWINGS

These and other objects of the present invention and the various features and details of the operation and construction of the container-closure in accordance with the present invention are hereinafter more fully set forth with reference to the accompanying drawings, wherein:

FIG. 1 is a side elevational view of a container-closure combination embodying a tamper-proof, break-away tear band in accordance with the present invention;

FIG. 1*a* is a perspective view of the break-away band before assembly to the container closure and prior to rolling the lower locking flanges inwardly;

FIG. 2 is a top plan view thereof;

FIG. 3 is an enlarged side elevational view partly in section showing the structural details of the container closure assembly in accordance with the present invention; and FIG. 4 is an exploded perspective view showing the parts after fracturing the break-away band.

DESCRIPTION OF THE PREFERRED EMBODIMENT

Referring now to the drawing, and particularly to FIGS. 1 and 2 thereof, there is shown a tamper-proof, break-away band or ring in accordance with the present invention applied to a container-closure combination. The container 10, which in the present instance is in the form of a bottle, has a reduced neck portion 12 with a conventional spiral screw thread 14 and a radially outwardly directed flange or finish 16 spaced axially below the screw thread 14. Note that the upper face 18 of the flange 16 is beveled outwardly and downwardly from a true horizontal plan P—P normal to the axis A—A of the bottle.

The closure, generally designated by the numeral 20, in the present instance comprises an inner cap member 22 and an overcap 24 which function as a unitary, integral unit. These caps are made of a plastic material such as polypropylene. The inner cap 22 includes a top (not shown) and a depending skirt 26 having internal threads 28 which cooperate and mesh with the threads 14 on the container or bottle so the cap can be actuated between open and closed positions. The outer cap has a disk-like top 32 and a circumferentially extending depending skirt 34 terminating in a circumferentially extending, outwardly directed flange 36. The inner and outer caps have interengaging locking beads 38 and 40 to retain them as a unitary assembly.

As best illustrated in FIG. 3, the tamper-proof break-away band of the present invention secures the cap assembly on the container in the closed position illustrated. In accordance with the present invention, the break-away band or ring 42 is initially of inverted L-shaped cross section comprising the upper radially inwardly directed flange 44 and the straight sided cylindrical depending skirt 46. Note that the scoring extends from slightly below the shoulder or corner edge which is the juncture between the cylindrical skirt portion and the upper flange and extends fully to the lower edge of the skirt. The band has in the present instance a series of circumferentially equi-spaced score lines 50 on the outer periphery thereof which, as illustrated, extend along the side wall or skirt 46 to a point adjacent the juncture 52 of the upper flange 44 and skirt 46.

Considering now briefly assembly of the break-away band in accordance with the present invention. The bottle 10 is filled with product usually in assembly-line fashion by automatic filling and handling equipment of well-known design and construction. The inner and outer overcaps 22 and 24 are then applied and threaded to the seated position shown in FIG. 3. The tamper-proof band 42 is then simply placed over the top of the cap. The maximum inner diameter of the skirt 46 of the ban 42 is of a large enough size to clear the cap so that it clears the flange of the outer cap and the bottle finish. The upper flange rests on the outer periphery of the cap flange. The lower edge 53 of the skirt 46 is then rolled by automatic equipment to form the lower inwardly directed flange 54 to secure it in place as shown in FIG. 3. Now when it is desired to remove the cap from the bottle, the user simply supports the bottle in one hand, presses down the crown of the cap with the outer, and turns the cap in the direction to remove it from the bottle. This turning action displaces the cap axially and exerts a prying axial force on the tear band 42 which causes separation of the ring at one of its weakest points, that is along one of the score lines. The tear band severs in the manner illustrated in FIG. 4 to permit removal of the cap completely. The separation of the band along the score lines also disfigures the band sufficiently to prevent reapplication to the bottle and cap in its original form and therefore truly provides indicia of the fact that the cap has been once removed.

Even though a particular embodiment of the invention has been illustrated and described herein, it is not intended to limit the invention and changes and modifications may be made therein within the scope of the following claims.

What is claimed is:

1. A tamper-proof ring for securing a closure over the open end of a container having a radial projection which lies closely adjacent the lower terminal edge of the closure when the closure is fully seated on the container in the closed position comprising a generally cylindrical body portion or sidewall, a continuous radially inwardly directed circumferentially extending upper flange devoid of any score line engaging over a bead on the closure, the body portion having a lower terminal edge constituting means for forming a radially inwardly directed lower flange engageable under the radial projection on the container and means defining at least two score lines substantially diametrically opposed and extending from the juncture of the upper flange and body portion to the lower edge of the body portion.

2. A tamper-evident band as claimed in claim 1 including four circumferentially equi-spaced score lines about the periphery of the band.

* * * * *